United States Patent [19]

Frolov

[11] Patent Number: 4,861,080

[45] Date of Patent: Aug. 29, 1989

[54] SUPPORT FOR ELECTROMAGNETIC SHEAR LOCK ARMATURE

[75] Inventor: George Frolov, Farmington, Conn.

[73] Assignee: Harrow Products, Inc., Grand Rapids, Mich.

[21] Appl. No.: 213,882

[22] Filed: Jun. 30, 1988

[51] Int. Cl.[4] ..... E05C 19/16

[52] U.S. Cl. ..... 292/251.5; 248/27.1; 248/558; 403/4

[58] Field of Search ..... 292/251.5, DIG. 60, 292/DIG. 55, 341.18, 341.19; 403/4; 248/27.1, 544, 916, 558, 588

[56] References Cited

U.S. PATENT DOCUMENTS

| | | | |
|---|---|---|---|
| 1,793,115 | 2/1931 | Model | 292/341.18 |
| 2,153,080 | 4/1939 | Flora | 292/341.19 |
| 2,904,364 | 9/1959 | Korodi | 292/251.5 |
| 3,345,102 | 10/1967 | Padgett | 292/251.5 |
| 4,233,794 | 11/1980 | Mayer | 403/4 X |
| 4,652,028 | 3/1987 | Logan et al. | 292/251.5 |

*Primary Examiner*—Lloyd A. Gall

*Attorney, Agent, or Firm*—Robert H. Montgomery

[57] ABSTRACT

A support system for the armature system of an electromagnetic shear lock on a door having a recessed top rail which comprises two pairs of spaced apart headed bolts threaded into the rail, each pair having a clamping plate below the heads thereof and a support plate resting on the heads of each pair, the support plate having recesses to provide access to the bolt heads, and the armature mounting plate is secured to the support plates. The bolt heads may be adjusted in height to align to the armature with a soffet mounted electromagnet.

4 Claims, 1 Drawing Sheet

SUPPORT FOR ELECTROMAGNETIC SHEAR LOCK ARMATURE

FIELD OF THE INVENTION

This invention relates to magnetic shear locks and more particularly relates to mountings for the armature thereof.

BACKGROUND OF THE INVENTION

Magnetic shear locks which are gaining more popularity comprise an electromagnet which is mounted into a cutout in the soffet of a doorway and an armature which is mounted within the top of the door and adapted to be attracted by the electromagnet, when energized, to secure the door in the frame. The doors may be hollow which have reinforcing ribs or rails extending horizontally below the top edge of the door. These rails may vary in depth from the top edge of the door dependent upon the manufacturer of the door. Additionally if the top rail is not parallel with the top of the door may be difficult to mount the armature parallel with the electromagnet. A further consideration in mounting the armature is where the door is not hung completely square so that the top edge is parallel with the soffet. Examples of electromagnetic shear locks are set forth in U.S. Pat. Nos. 4,487,439 and 4,562,665. Electromagnetic shear locks, while providing a magnetic holding force must also rely on a mechanical retaining force to ensure security. For this additional reason it is imperative that the electromagnet and armature be properly aligned.

Accordingly, the present invention provides a new and improved mounting mechanism for the armature of an electromagnetic shear lock on inverted top rail doors.

SUMMARY OF THE INVENTION

Briefly stated, the invention in one form thereof comprises the provision of two mounting bolts at each end of the armature which are received in the top rail of a door which carry beneath the heads thereof clamping plates. The mounting bolts associated with each clamping plate may be adjusted up or down in order to provide a support which will level the armature with the top edge of the door. Support plates are then attached to the clamping plate by means of a bolt extending through the support and clamping plates to provide a level surface. This is accomplished at spaced apart points to provide support for the opposite ends of the mounting plate for an armature. A mounting plate for the armature is secured to the support plates. If necessary, the mounting bolts may then by adjusted to align the armature with the electromagnet.

An object of this invention is to provide a new and improved mechanism which is easy to install and adjust for properly mounting the armature of electromagnetic shear lock in a door.

The features of the invention which are believed to be novel are particularly pointed out and distinctly claimed in the concluding portion of this specification. The invention, however, together with further objects and advantages thereof may best be appreciated by reference to the following detailed description taken in conjunction with the drawings.

DESCRIPTION OF PREFERRED EMBODIMENT OF THE INVENTION

Figure 1:
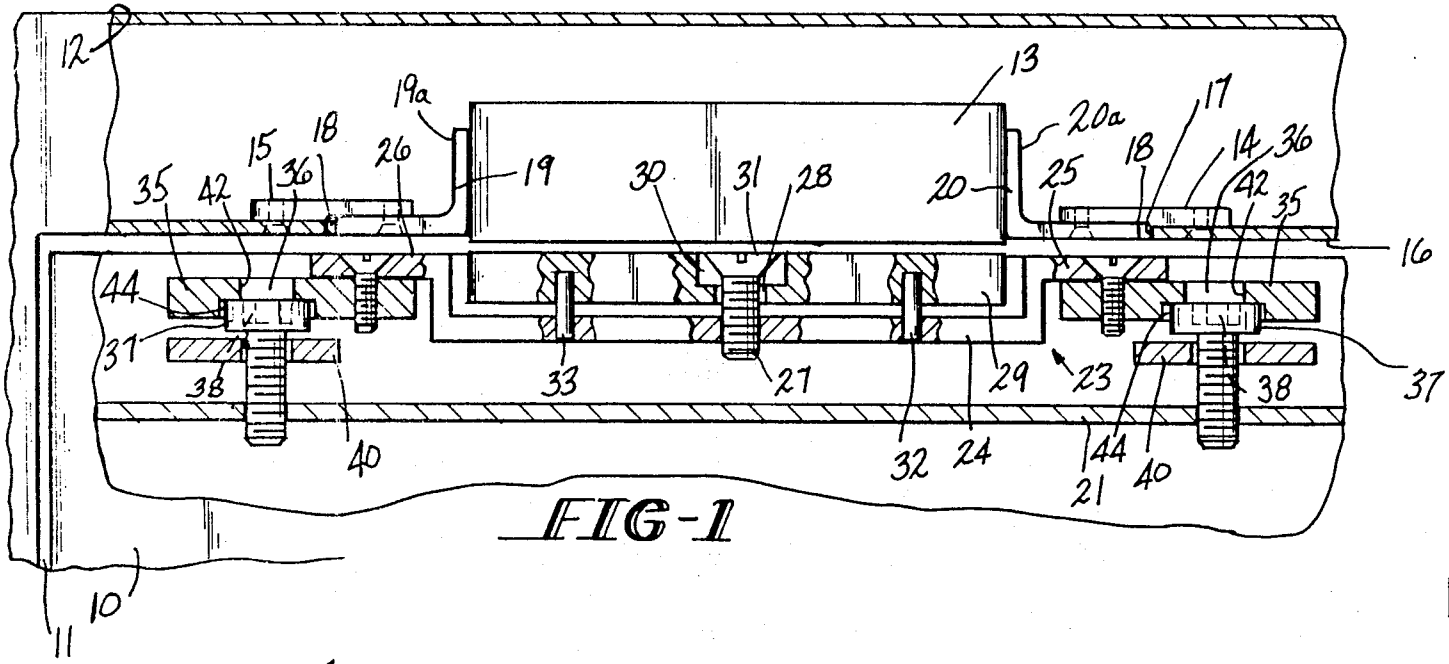
FIG. 1 is a front elevation of a part of a door and door frame partially cut away to show the mounting mechanism embodying the invention.
Figure 3:
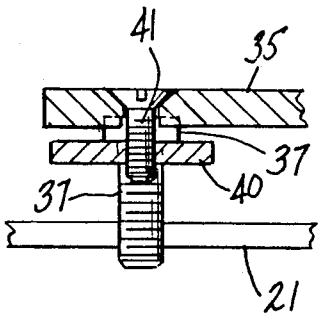
FIG. 3 is a sectional view seen in the plane of lines 3—3 of FIG. 2.
Figure 2:
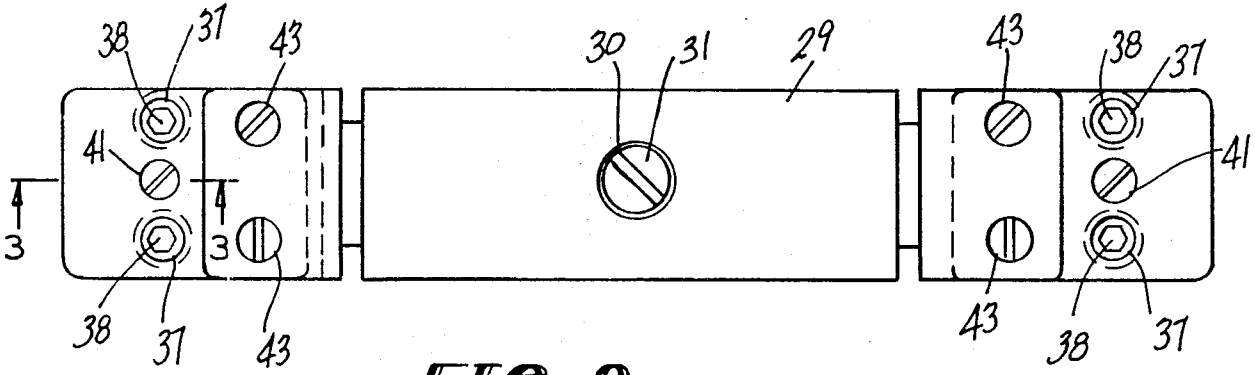
FIG. 2 is a top view of the armature mechanism of FIG. 1.

FIG. 1 exemplifies a door 10 closing a doorway 11 which is defined by a door frame 12.

In FIG. 1 the door frame 12 is shown as being of a hollow metal configuration and a portion is removed therefrom to permit insertion of an electromagnet 13. When a portion of the door frame has been removed to define an opening to the hollow interior mounting plates 14 and 15 are fixed to the soffet 16 of the doorway by means of screws or bolts. The mounting plate 14 and 15 extend over an opening 17 defined in the door frame and are recessed on the bottom at 18. Non-magnetic L-shaped support members 19 and 20 are secured to the recessed portions 18 of mounting plates 14 and 15 and provide upright arms **19*a* and 20*a* which receive electromagnet 13 therebetween. The electromagnet is secured to the upright arms 19*a* and 20*a*** by a plurality of screws not shown.

Electromagnet 13 is generally of E-shaped cross section as described in copending Application Ser. No. 014,831, filed Feb. 13, 1987, and defines a recess between the outer two legs between which the armature is received when the electromagnet is energized. The door 10 which is generally of a hollow metal structure has a stiffening member or rail 21 therein upon which the armature is mounted. An armature assembly 23 comprises an armature mounting plate 24 having upper flanges 25 and 26 which are mounted on a support assembly hereinafter described. Mounting plate 24 is of non-magnetic material, usually aluminum. Mounting plate 24 receives a bolt 27 therein which extends through an aperture 28 in armature 29. The top of the passage 28 is countersunk at 30 to receive the head 31 of bolt 27. This arrangement permits the adjustment of movement of the armature. Plate 24 carries guide pins 32 and 33 which extend into apertures in armature 29 and prevent any rotational movement thereof.

The flanges 25 and 26 of the armature mounting plate are adapted to rest on and be secured to support plates 35 at either end of the armature assembly 23.

The support plates 35 have apertures 36 therethrough providing communication with upper surfaces of larger diameter heads of bolts 37. The support plates rest on the heads of bolts 37. The upper surfaces of the heads of bolts 37 have sockets 38 therein adapted to receive a turning tool such as an Allen Wrench. The support plates rest on the bolt heads outside the socket area. Bolts 37 are threadably received in stiffener 21 for vertical positioning adjustment. Extending through support plates 35 and positioned between a pair of bolts 37 is another bolt 41 having a head which engages a support plate 35 and is threadably received in clamping plate 40. Initially, the clamping plates 40 are loose on bolts 37 and beneath the heads thereof. The bolts 37 may then be adjusted upwardly or downwardly to have their heads provide a predetermined height of support for the armature assembly 23 at either end thereof and adjust the top of the armature when the electromagnet is deenergized to be parallel with the electromagnet and at or slightly near the top edge of the door 10. This is achieved by tightening the heads of the bolts 41 which will pull clamping plates 40 up against the underside of the heads of bolts 37.

Any minor adjustment may then be made through a turning tool inserted in the sockets 38 of bolts 37 through passages 42 provided in support plates 35. When the mounting assembly has been properly adjusted the armature assembly 23 may then be affixed through flanges 25 and 26 to support plates 35 by means of bolts or screws 43. Annular recesses 44 are defined in the underside of support plates 35 to locate and position the support plates on the heads of bolts 37. The recesses are concentric with passages 42.

This mounting arrangement provides an easy to install and adjust mechanism for the armature of electromagnet shear lock regardless of the position of the top stiffening member 21, or any discrepancies of the squareness of the door 10 with the door frame, or any deviation from the horizontal of stiffener or rail 21.

It must be seen that the object of the invention set forth, as well as those made apparent from the foregoing description are efficiently attained. While a preferred embodiment of the invention has been set forth for the purposes of disclosure, modifications to the disclosed embodiment of the invention as well as other embodiments thereof may occur to those skilled in the art. Accordingly, the appended claims are intended to cover all embodiment of the invention and modifications to the disclosed embodiment which do not depart from the spirit and scope of the invention.

Having described the invention, what is claimed is:

1. A support system for the armature of an electromagnetic shear lock in a door having a rail spaced from the top edge thereof where the armature includes a mounting plate having mounting flanges at either end thereof, comprising two pairs of spaced apart headed bolts, each pair having a clamping plate below the heads thereof, a support plate on the heads of each pair of bolts and secured to each clamping plate, the mounting flanges of said mounting plate being secured to said support plate, and passages defined in said support plates to permit access to the heads of said bolts.

2. The support system of claim 1 where said bolts have sockets defined in the heads thereof, and said sockets are accessible through said passages.

3. The support system of claim 1 where said support plates have recesses in the underside thereof to receive the heads of said bolts.

4. The support system of claim 3 where said bolts have sockets defined in the heads, said sockets are accessible through said passages, and said passages and said recesses are concentric.

* * * * *